US005119870A

United States Patent [19]

Rabberman

[11] Patent Number: 5,119,870

[45] Date of Patent: Jun. 9, 1992

[54] BIFOLD DOOR CONSTRUCTION

[76] Inventor: James V. Rabberman, 341 10th St., Apt. 2L, Brooklyn, N.Y. 11215

[21] Appl. No.: 658,253

[22] Filed: Feb. 19, 1991

[51] Int. Cl.[5] ..... E05D 15/00

[52] U.S. Cl. ..... 160/210; 49/462

[58] Field of Search ..... 160/206, 199, 210; 16/247, 245, 378, DIG. 27, DIG. 35; 49/462

[56] References Cited

U.S. PATENT DOCUMENTS 2,586,240 2/1952 Malarky ..... 49/462 X
3,494,408 2/1970 D'Ercole ..... 160/206
4,240,225 12/1980 Sartain ..... 49/462

FOREIGN PATENT DOCUMENTS 8802909 6/1990 France ..... 49/462

*Primary Examiner*—Blair M. Johnson
*Attorney, Agent, or Firm*—Leon Gilden

[57] ABSTRACT

A door construction is provided, wherein a top and bottom wall of an associated door mounts a wear plate thereon, wherein the wear plate includes a guide roller to provide proper spacing of the door within a door space. A modification of the invention includes a wear plate defined by an arcuate exterior surface, with a slot receiving a wedge therewithin for spreading of an end portion of the plate to effect proper spacing of the door within a door frame structure.

2 Claims, 4 Drawing Sheets

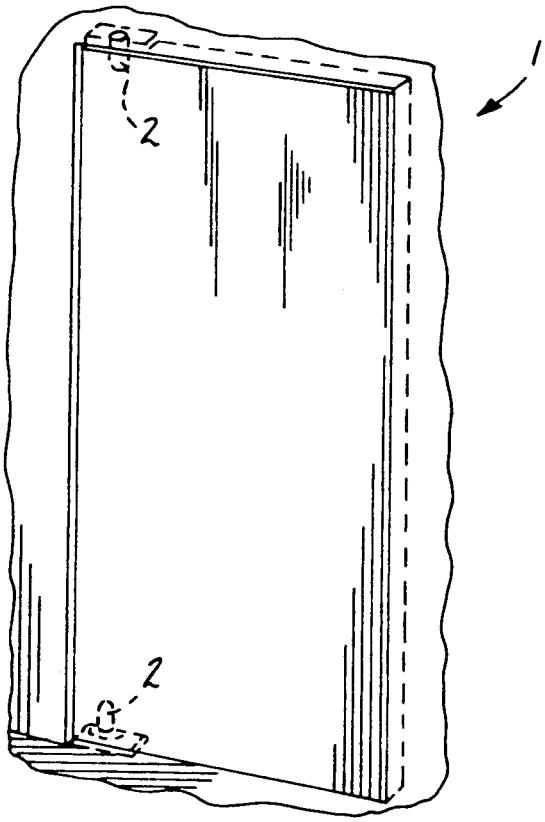
Fig 1
PRIOR ART
Fig 2
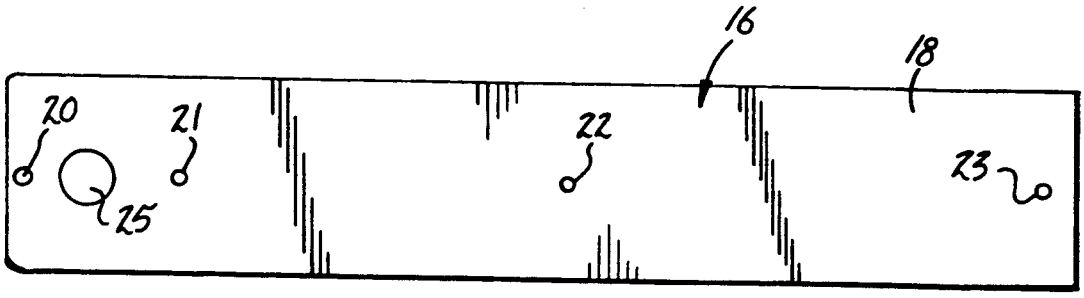

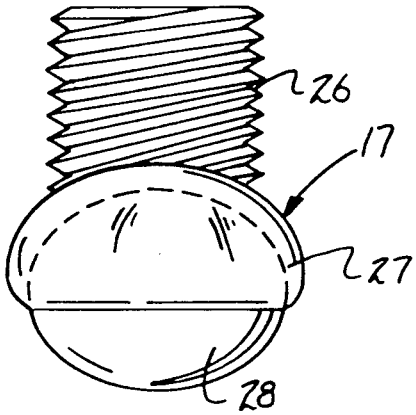
Fig 5
Fig 6
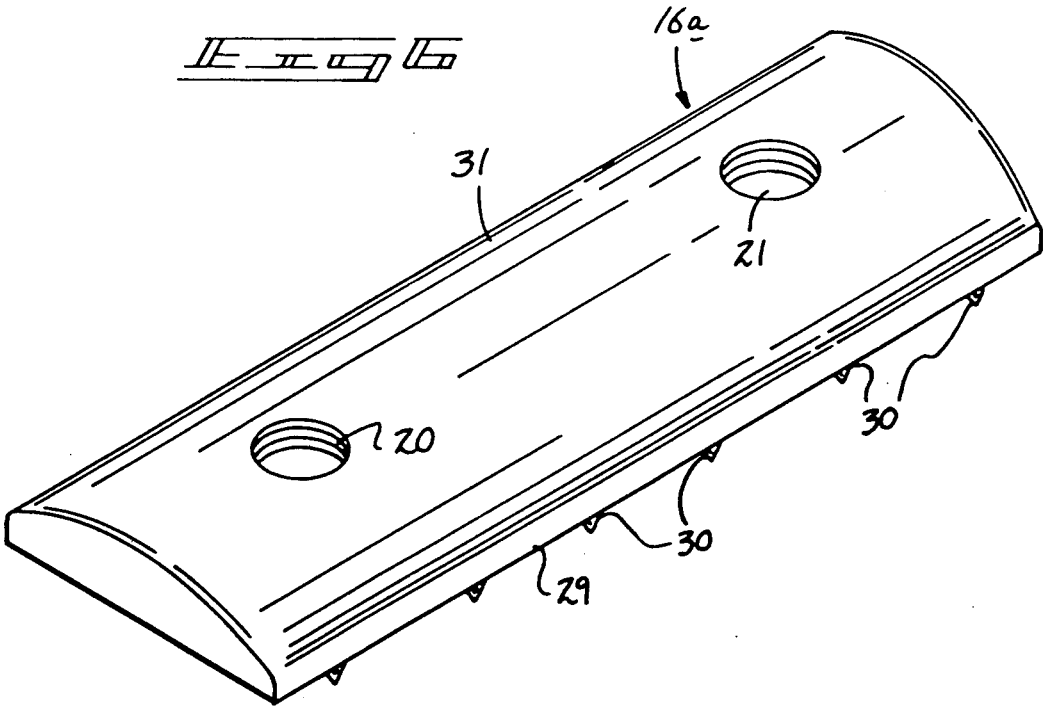

BIFOLD DOOR CONSTRUCTION

BACKGROUND OF THE INVENTION

1. Field of the Invention

The field of invention relates to door apparatus, and more particularly pertains to a new and improved bifold door construction wherein the same effects mounting and proper spacing of a door within a door frame and further provides for a wear surface to effect contact between a door and door frame to avoid abrasive contact of the door with the door frame.

2. Description of the Prior Art

Doors and their mounting with an associated door frames are accompanied by various prior art structure to effect this result for proper positioning of a door therewithin. Heretofore, however, the prior art has not provided a convenient and readily mounted structure to enhance positioning of the door in a proper alignment of the door frame as set forth by the instant invention. Examples of the prior art include U.S. Pat. No. 3,932,913 to Johnson setting forth a pivot assembly mounted within a recess within bottom surfaces of the door to provide pivoting of the door relative to a door frame.

U.S. Pat. No. 4,209,946 to Akai sets forth pivot mechanisms mounted to bottom and top surfaces of a window for providing a pivot structure within the window.

U.S. Pat. No. 3,325,942 to Bejrano sets forth a further example of a pivoting structure mounted to a door.

As such, it may be appreciated that there continues to be a need for a new and improved bifold door construction as set forth by the instant invention which addresses both the problems of ease of use as well as effectiveness in construction utilizing a wear or scuff plate mounted to the top and bottom surfaces of an associated door to minimize abrasive action of the door during its repeated opening and closure relative to a door frame.

SUMMARY OF THE INVENTION

In view of the foregoing disadvantages inherent in the known types of door apparatus now present in the prior art, the present invention provides a bifold door construction wherein the same utilizes a wear receiving door plate for mounting to top and bottom surfaces of an associated door to accommodate abrasive action of a door in use. As such, the general purpose of the present invention, which will be described subsequently in greater detail, is to provide a new and improved bifold door construction which has all the advantages of the prior art door construction and none of the disadvantages.

To attain this, the present invention provides a door construction wherein a top and bottom wall of an associated door mounts a wear plate thereon, wherein the wear plate includes a guide roller to provide proper spacing of the door within a door space. A modification of the invention includes a wear plate defined by an arcuate interior surface, with a slot receiving a wedge therewithin for spreading of an end portion of the plate to effect proper spacing of the door within a door frame structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bifold door construction which has all the advantages of the prior art door constructions and none of the disadvantages.

It is another object of the present invention to provide a new and improved bifold door construction which may be easily and efficiently manufactured and marketed.

It is a further object of the present invention to provide a new and improved bifold door construction which is of a durable and reliable construction.

An even further object of the present invention is to provide a new and improved bifold door construction which is susceptible of a low cost of manufacture with regard to both materials and labor, and which accordingly is then susceptible of low prices of sale to the consuming public, thereby making such bifold door constructions economically available to the buying public.

Still yet another object of the present invention is to provide a new and improved bifold door construction which provides in the apparatuses and methods of the prior art some of the advantages thereof, while simultaneously overcoming some of the disadvantages normally associated therewith.

Still another object of the present invention is to provide a new and improved bifold door construction wherein the same receives in a convenient and readily mounted manner a scuff plate mounted to bottom and top end surfaces of a door to accommodate abrasion on the scuff plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art door construction.

FIG. 4 is an orthographic view, taken in elevation, of a bifold door construction utilized by the instant invention and the associated scuff plates mounted thereon.

FIG. 5 is an orthographic side view of a roller member mounted to the scuff plate construction, as illustrated in FIG. 4.

FIG. 6 is an isometric illustration of a modified scuff plate utilized by the instant invention.

DESCRIPTION OF THE PREFERRED EMBODIMENT

Figure 3:
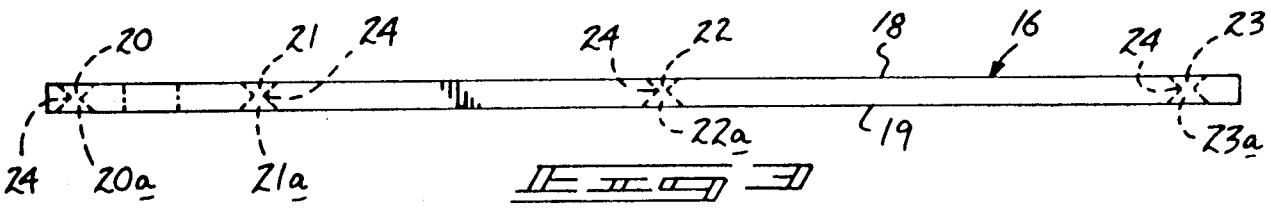
FIG. 3 is an orthographic side view of the scuff plate utilized by the instant invention.
Figure 2:
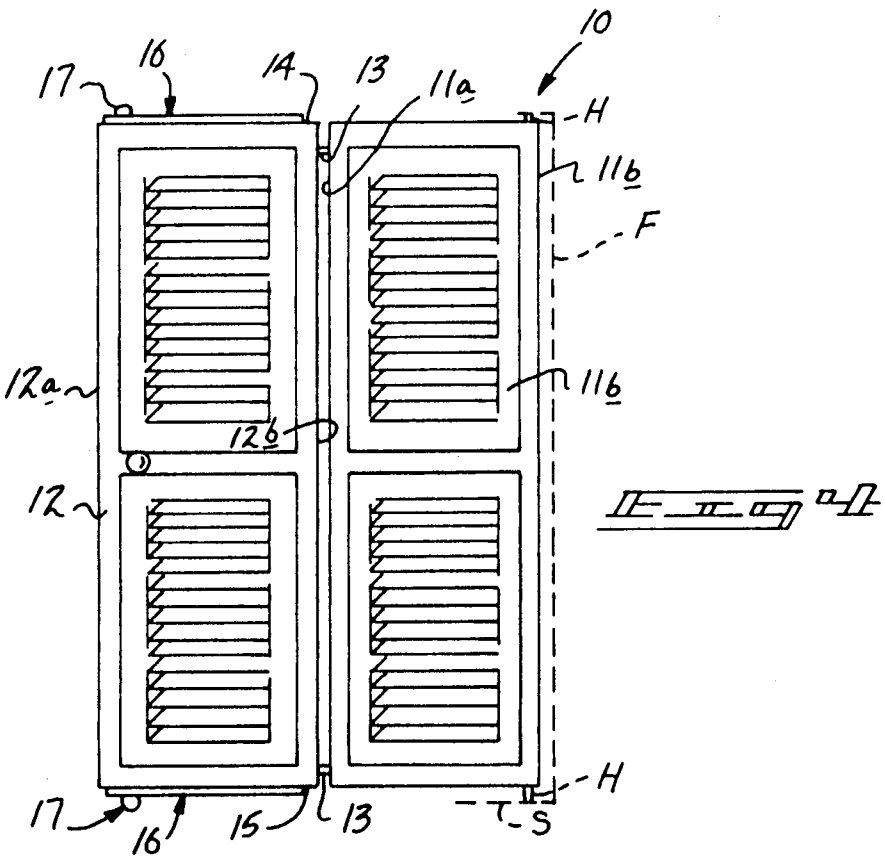
FIG. 2 is a top orthographic view of a scuff plate utilized by the instant invention.

With reference now to the drawings, and in particular to FIGS. 1 to 9 thereof, a new and improved bifold door construction embodying the principles and concepts of the present invention and generally designated by the reference numeral 10 will be described.

FIG. 1 illustrates a prior art door construction, as exemplified in U.S. Pat. No. 3,932,913, wherein the door construction 1 includes an upper and lower pivot means 2 mounted to the door, wherein a typical manner, the door is not supported at its free ends remote from the hinges.

More specifically, the bifold door construction 10 of the instant invention essentially comprises a first door 11 defined by a left side wall 11*a* and a right side wall 11*b* hingedly mounted through a plurality of door hinges 13 to a second door 12 defined by a second door left side 12*a* and a second door right side 12*b*. The second door includes a top side wall 14 and a bottom side wall 15 mounted within a door framework "F", wherein the bottom side wall 15 overlies a support surface "S". Conventional hinge structure "H" mounts the first door 11 within the door frame. The top and bottom side walls 14 and 15 respectively each include a mounting plate 16, wherein the mounting plate includes a top plate surface 18 and a bottom surface 19. The top plate surface 18 includes a respective first, second, third, and fourth conical recess that are each coaxially aligned with a respective bottom surface first, second, third, and fourth conical recess 20*a*, 21*a*, 22*a*, and 23*a* respectively. These recesses are coaxially aligned by a connecting bore 24 to receive fasteners therethrough to mount the plates to the top and bottom surfaces of the second door. A roller contact member 17 is received within an internally threaded bore 25. Lower contact member 17, as illustrated in FIG. 5, includes a threaded shank 26 mounting a roller housing 27 at a lower terminal end thereof that rotatably mounts a spherical roller 28 therewithin to effect rolling contact of each roller contact member 17 with respective contact members within the door framework "F".

Figure 9:
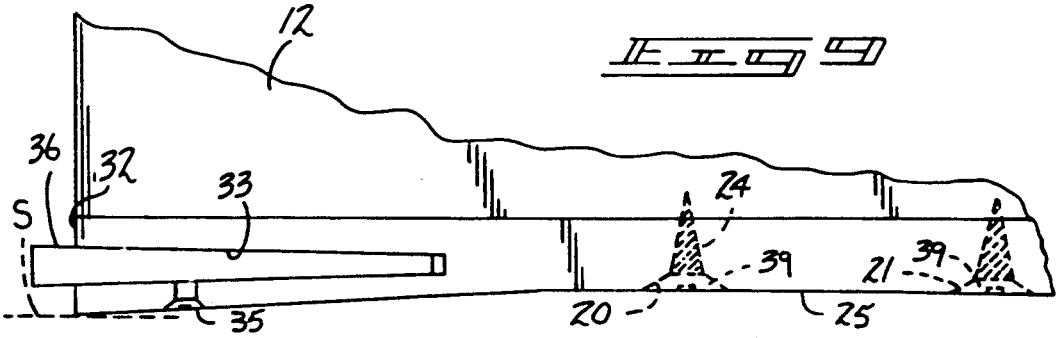
FIG. 9 is an orthographic side view of the scuff plate receiving an expanding wedge for adjustment of the modified scuff plate relative to a door frame structure.

FIG. 6 illustrates a modified mounting plate 16*a* defined as a scuff plate, including a plurality of through-extending openings 20 and 21, including conical recesses, as illustrated in FIG. 3 for example, to receive mounting fasteners 39 therethrough, as illustrated in FIG. 9. The scuff plate 16*a* includes a planar bottom surface 29 coextensive with and underlying an arcuate top surface 31. The bottom surface 29 includes spaced parallel side edges, each mounting a plurality of anchoring spikes 30 that project orthogonally and downwardly relative to the bottom surface 29 for permitting initial positioning of the bottom surface 29 onto a respective top or bottom side wall 15 or 16. The arcuate top surface provides a bearing surface for movement of the second door 12 or the free end thereof remote from the hinges "H" to engage abrading surfaces of the framework "F" or underlying surface "S", such as exemplified in FIG. 9.

Figure 7:
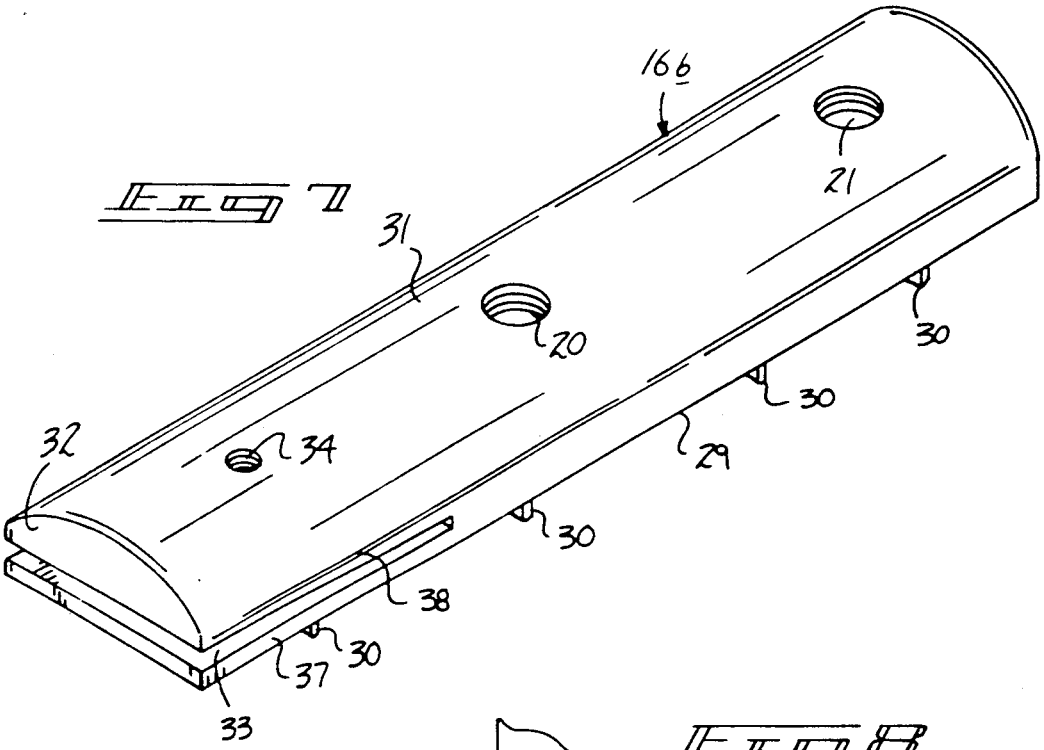
FIG. 7 is an isometric illustration of a further modified scuff plate utilized by the instant invention.
Figure 8:
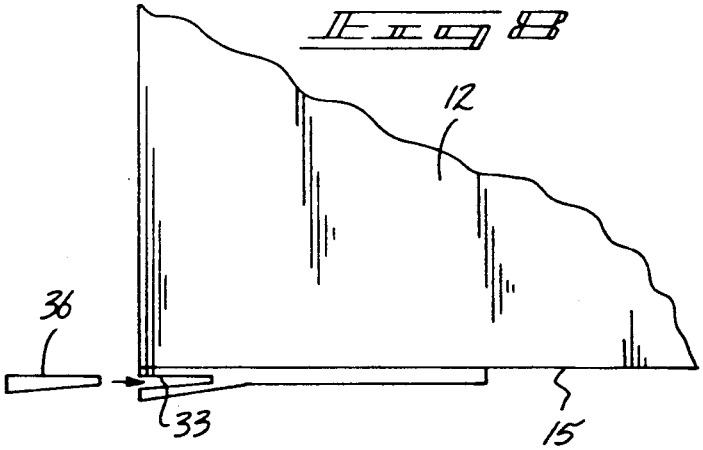
FIG. 8 is an orthographic side view illustrating the detailed scuff plate mounted to a bottom surface of the associated door.

FIGS. 7–9 illustrate a further modified scuff plate 16*b*, wherein the arcuate top surface in addition to the conical recesses 20 and associated mounting bores includes a wedge receiving slot 33 that is orthogonally directed from an end wall 32 between sides of the scuff plate 16*b*, wherein the wedge receiving slot 33 includes an anchor fastener receiving threaded bore 34 that orthogonally intersects the slot 33 and is directed from the arcuate top surface 31 into the slot 33 to receive an anchor fastener 35. The anchor fastener 35 anchors a wedge plate 36 that is selectively projected a predetermined distance into the slot 33, wherein the wedge plate 36 is of a generally trapezoidal cross-sectional configuration to spread a top leg 38 relative to a bottom leg 37 defined by the wedge receiving slot 33. This permits positioning of a free edge of the door 12 as required to provide proper spacing and positioning of the door within the associated framework "F". As illustrated, the slot 33 is coextensive between the side edges of the top and bottom surfaces 29 and 31 and projects interiorly of the scuff plate medially thereof spaced from the top surface first conical recess 20 and its associated connecting bore 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bifold door construction comprising, in combination, a first door including a first door left side wall and a first door right side wall, and a second door including a second door left side wall and a second door right side wall, wherein the first door left side wall and the second door right side wall include a plurality of interconnecting hinges, and the first door is pivotally mounted within a door framework, and the second door including a second door top side wall and a second door bottom side wall in confronting relationship relative to the door framework, and a scuff plate mounted to the second door top side wall and the second door bottom side wall, wherein the scuff plate includes a plurality of openings and the openings each include a fastener directed therethrough to mount each scuff plate to the respective top side wall and the bottom side wall, and each scuff plate includes a planar bottom surface, and each planar bottom surface is arranged for securement to the respective second door top side wall and second door bottom side wall, and the planar bottom surface includes a plurality of elongate side edges, each side edge including a plurality of anchoring spikes orthogonally mounted to each side edge, and the scuff plate further including an arcuate bearing surface for confronting relationship within the door framework, and wherein the arcuate bearing surface is defined by an arcuate top surface coextensive with the top surface of the scuff plate and coextensive with the planar bottom surface, and wherein the scuff plate includes an end wall orthogonally oriented relative to the planar bottom surface, and the end wall includes a wedge receiving slot orthogonally oriented relative to the end wall and projecting medially of the scuff plate, wherein the wedge receiving slot defines a top leg between the slot and the arcuate top surface and the bottom leg between the slot and the bottom surface, and the top leg including an internally threaded anchor fastener receiving bore orthogonally oriented relative to the planar bottom surface, and an internally threaded fastener directed through the threaded bore.

2. An apparatus as set forth in claim 1 further including a wedge plate receivable within the wedge receiving slot, wherein the fastener is arranged to intersect and impose upon the wedge plate to selectively affix the wedge plate within the wedge receiving slot in a predetermined orientation within the wedge receiving slot.

* * * * *